US011259661B2

(12) United States Patent
Blanch et al.

(10) Patent No.: US 11,259,661 B2
(45) Date of Patent: Mar. 1, 2022

(54) SNACK CONTAINMENT AND DISPENSING APPARATUS AND USE THEREOF

(71) Applicant: Tomo Technologies Inc., Provo, UT (US)

(72) Inventors: Joseph Blanch, Pleasant Grove, UT (US); Westin Dangerfield, Provo, UT (US); Solanda Moran, Pleasant Grove, UT (US)

( * ) Notice: Subject to any disclaimer, the term of this patent is extended or adjusted under 35 U.S.C. 154(b) by 0 days.

(21) Appl. No.: 16/711,491

(22) Filed: Dec. 12, 2019

(65) Prior Publication Data

US 2020/0187691 A1 Jun. 18, 2020

Related U.S. Application Data

(60) Provisional application No. 62/779,397, filed on Dec. 13, 2018.

(51) Int. Cl.
*A47G 19/32* (2006.01)
*B65D 83/00* (2006.01)

(52) U.S. Cl.
CPC ..... *A47G 19/32* (2013.01); *B65D 83/0038* (2013.01)

(58) Field of Classification Search
None
See application file for complete search history.

(56) References Cited

U.S. PATENT DOCUMENTS 4,572,403 A * 2/1986 Benaroya ..... A61J 7/04 221/15
5,501,365 A * 3/1996 Richiger ..... A61J 9/001 221/63
2011/0253737 A1* 10/2011 Portney ..... B65D 83/0454 221/277
2011/0284568 A1* 11/2011 Leifeld ..... B65D 83/0418 221/1
2014/0339248 A1* 11/2014 Reddy ..... G16H 20/13 221/1

* cited by examiner

*Primary Examiner* — Gene O Crawford
*Assistant Examiner* — Ayodeji T Ojofeitimi
(74) *Attorney, Agent, or Firm* — John L. Sotomayor

(57) ABSTRACT

The present invention is a snack containment and dispensing apparatus having a plurality of separate snack containment compartments, a preferably transparent lid having an opening therein, and a plunger or like means to index or rotate the lid such that access to a singular snack compartment is obtained one-at-a-time. By selectively accessing only one snack compartment at a time, the snacks in the other non-currently accessed snack compartments are rendered non-spillable. Moreover, by providing indexable access to a snack compartment, a user—typically a child—not only gains access to a snack contained therein but is also provided snack choice autonomy and entertainment thereby.

14 Claims, 14 Drawing Sheets

SNACK CONTAINMENT AND DISPENSING APPARATUS AND USE THEREOF

TECHNICAL FIELD

The present invention relates to ingestibles containment and dispensing apparatuses, and in particular, to containment apparatuses having selective dispensing of snacks while providing spill resistance of such snacks and entertainment for the apparatus user, and methods of use thereof.

BACKGROUND

Various devices are known in the art to convert linear motion into a torque or rotational/angular motion. Exemplary of such devices is U.S. Pat. No. 5,797,319 entitled "Drive Device for a Folder in a Printing Press" to Tomczak which is expressly incorporated herein by reference. Various means and devices are known in the art for storing snacks and like ingestibles, and for selectively dispensing and/or rendering availability to such snacks. However, such means and devices have typically been rendered substantially the whole of such snacks spillable or have been void of an entertainment aspect.

SUMMARY

A snack containment and dispensing apparatus is provided. The snack containment and dispensing apparatus includes a tray disposed including one or more pockets. A lid is connectable with the tray and including an opening. The tray is configured for selective rotation relative to the tray to align one of the one or more pockets with the opening. An actuator is configured to actuate rotation of the tray.

A snack containment and dispensing apparatus comprises a bowl. A lid is connectable with the bowl. The lid includes an opening having a hinged flap. A tray is disposed with the bowl. The tray includes five pockets and is configured for selective rotation relative to the bowl to align one of the five pockets with the opening. A plunger button configured to actuate rotation of the tray.

A snack containment and dispensing apparatus comprising a bowl. A tray having a plurality of containment compartments. A plunger device having a lid with at least one opening therein. The apparatus is adapted such that when said plunger is depressed, said tray indexes such that exposed access of a containment compartment is changed from a first containment compartment to a second containment compartment.

BRIEF DESCRIPTION OF THE DRAWINGS

The present disclosure will become more readily apparent from the specific description accompanied by the following drawings, in which.

DETAILED DESCRIPTION

The described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

The system of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. In some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a snack containment and dispensing apparatus in accordance with the principles of the present disclosure. Alternate embodiments are also disclosed. Reference is made in detail to the exemplary embodiments of the present disclosure, which are illustrated in the accompanying figures. Turning to FIGS. 1-14, there are illustrated components of a snack containment and dispensing apparatus, such as, for example, a container system 10. Container system 10 is configured to allow access to one compartment of a tray at a time by providing for selective rotation of the tray for alignment with an opening disposed with a lid.

Figure 1:
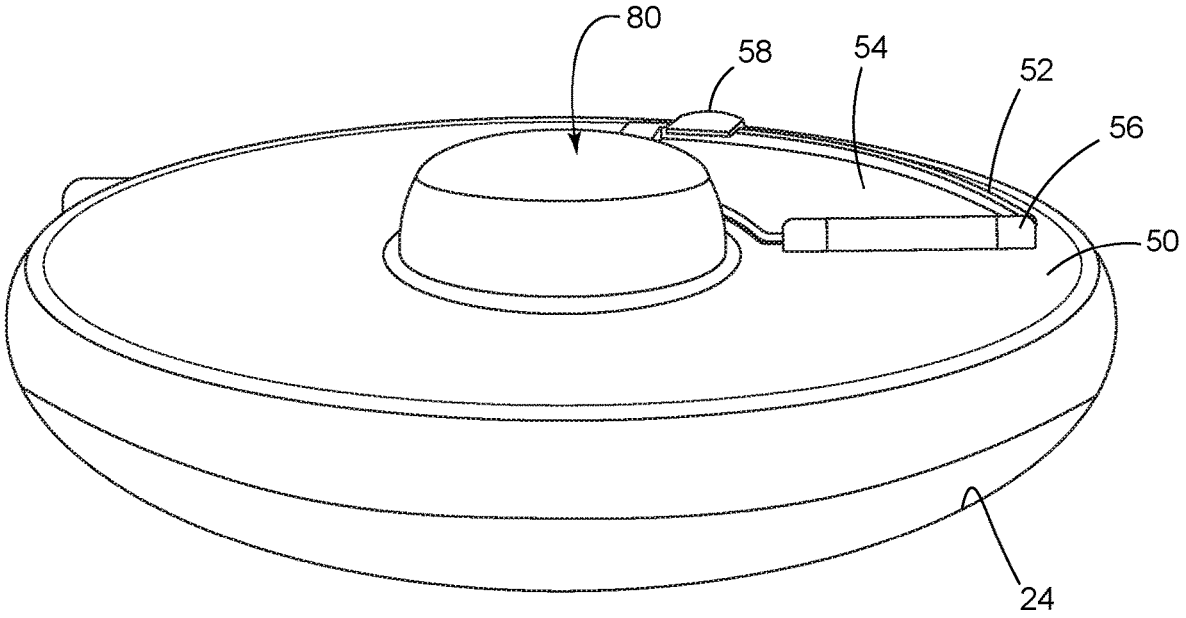
FIG. 1 is a perspective view of the components of one embodiment of a snack containment and dispensing apparatus in accordance with the principles of the present disclosure.
Figure 2:
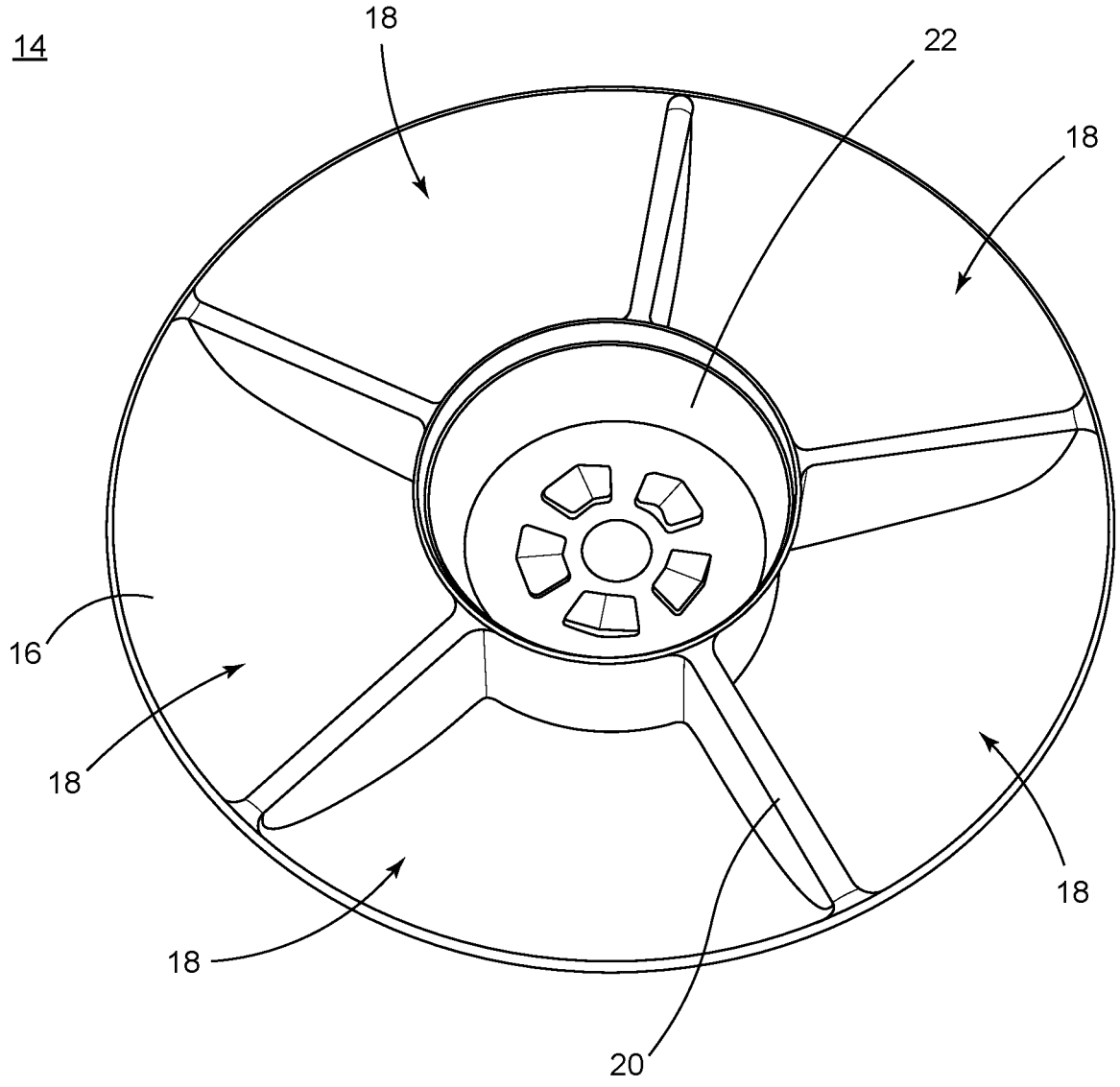
FIG. 2 is a plan view of the components of one embodiment of a snack containment and dispensing apparatus in accordance with the principles of the present disclosure.
Figure 3:
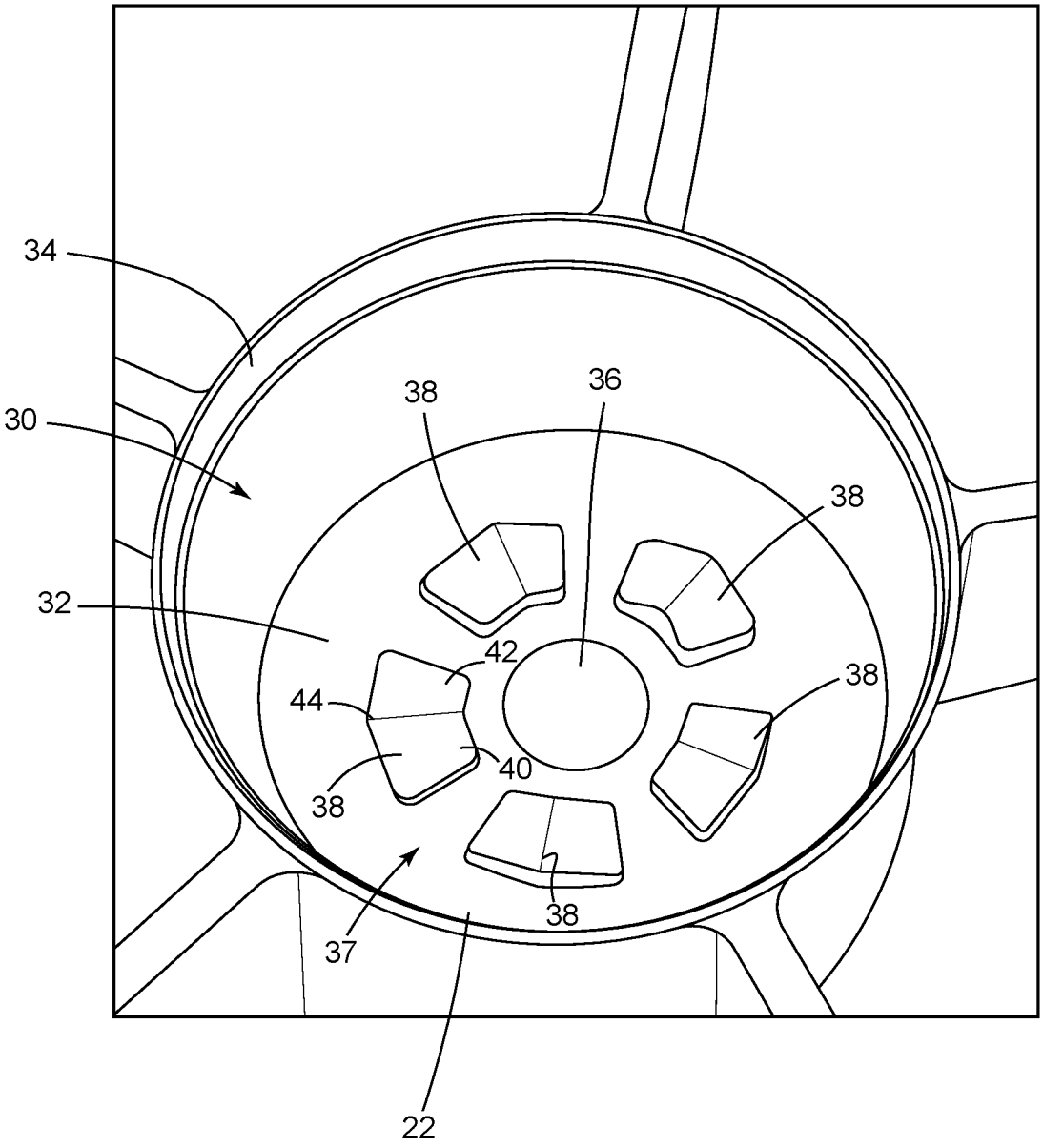
FIG. 3 is an enlarged view of the components of FIG. 2

Container system 10 includes a tray 14 configured to contain snacks S therein. Tray 14 includes a substantially round dish shaped member. Tray 14 includes a surface 16 that defines one or a plurality of containment compartments, for example, pockets 18. Pockets 18 are separated by walls 20. Pockets 18 may include various configurations, for example, oval, oblong, triangular, square, polygonal, irregular, uniform, non-uniform, offset, staggered, and/or tapered. Pockets 18 are circumferentially disposed about a central opening 22, as shown in FIG. 2 Snacks S are disposable within pockets 18, as shown in FIGS. 2 and 3. Walls 20 provide a separation between snacks S. Tray 14 is selectively rotatable to provide access to one of pockets 18, as described herein. Tray 14 includes an outer bottom surface that defines a cavity 23.

Figure 4:
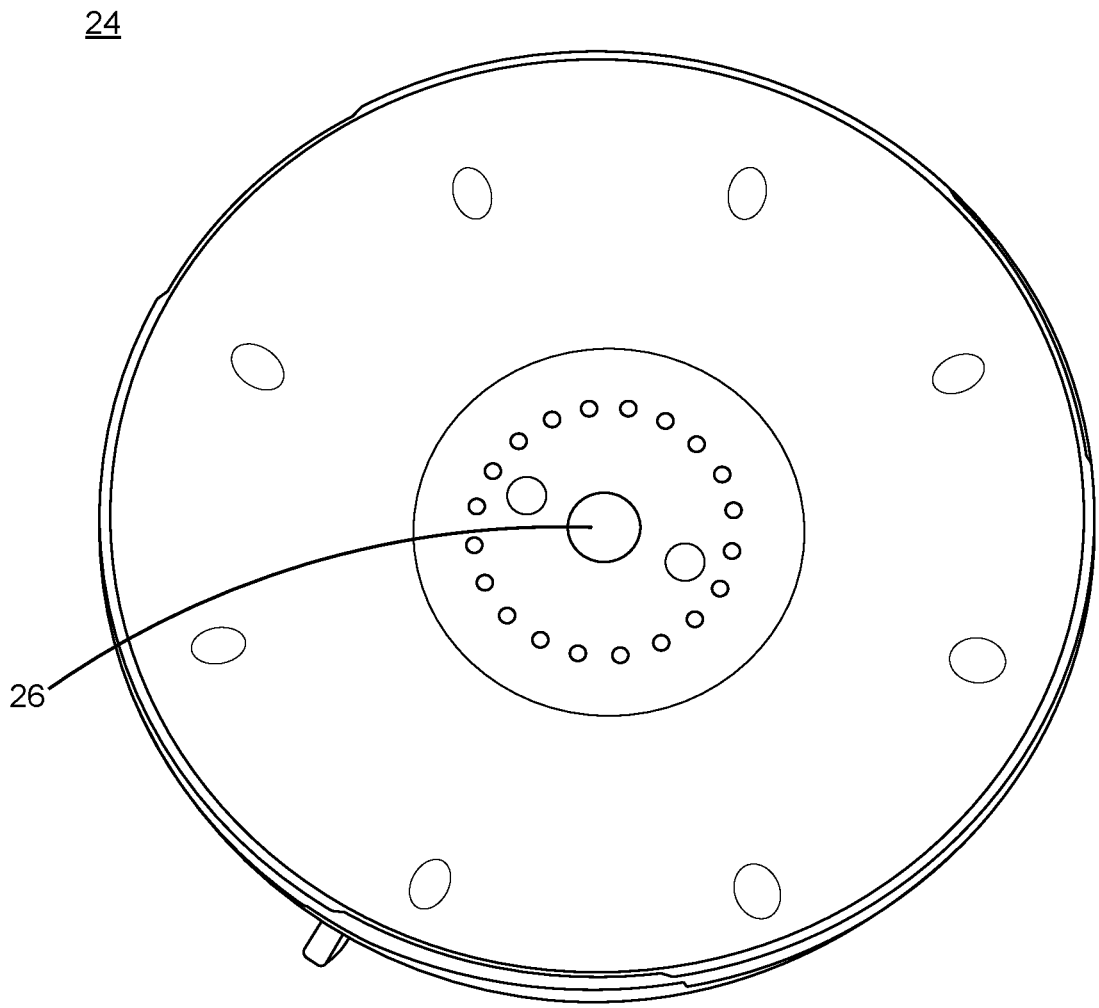
FIG. 4 is a plan view of the components of one embodiment of a snack containment and dispensing apparatus in accordance with the principles of the present disclosure.
Figure 5:
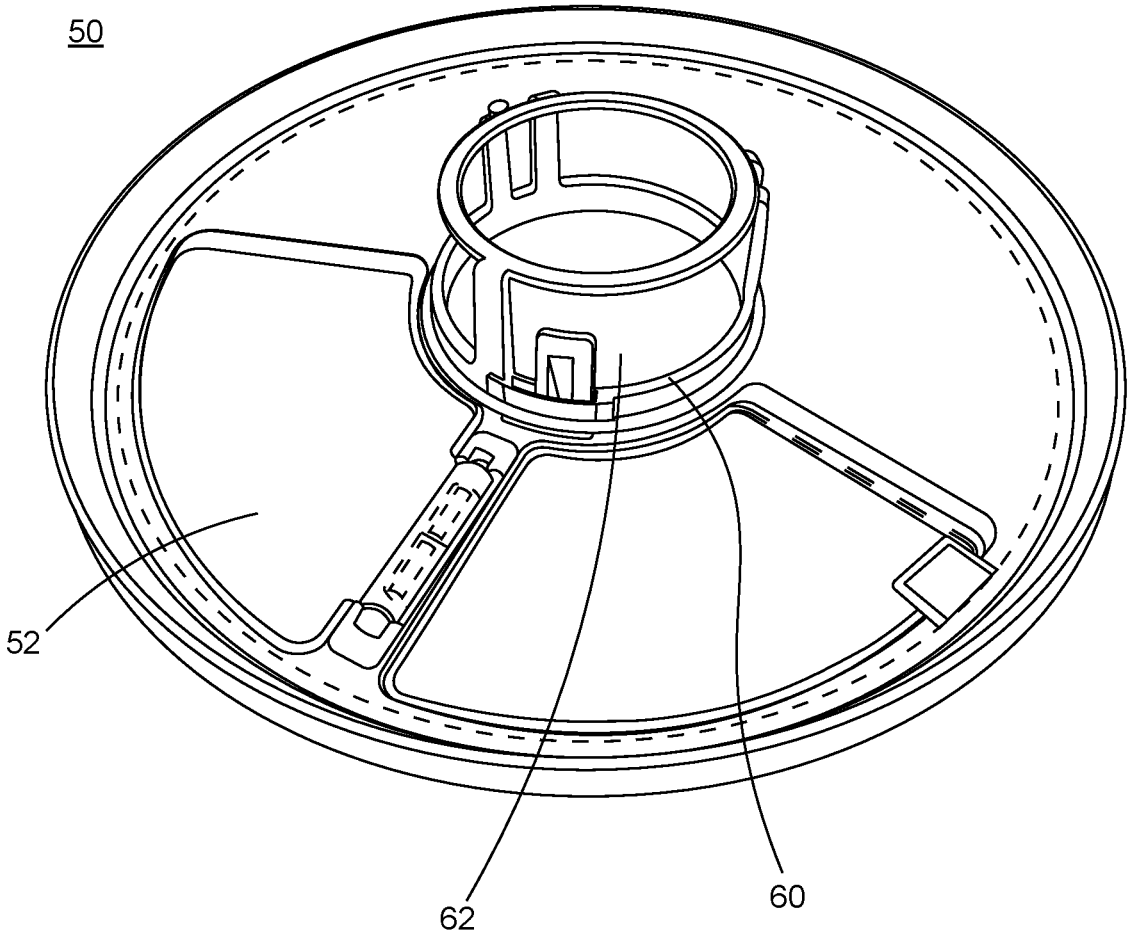
FIG. 5 is a plan view of the components of one embodiment of a snack containment and dispensing apparatus in accordance with the principles of the present disclosure.
Figure 6:
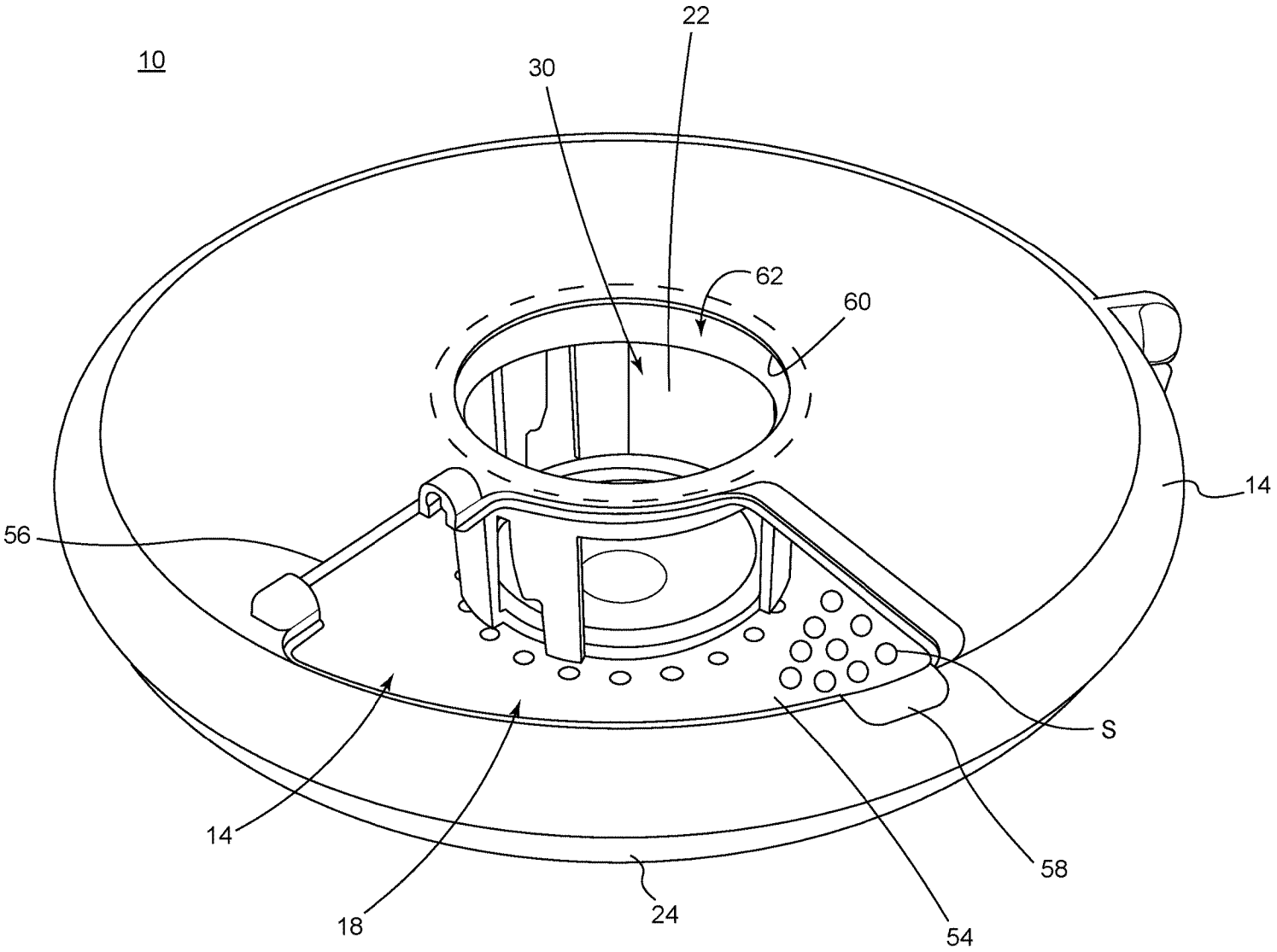
FIG. 6 is a perspective view of components of one embodiment of a snack containment and dispensing apparatus in accordance with the principles of the present disclosure.
Figure 7:
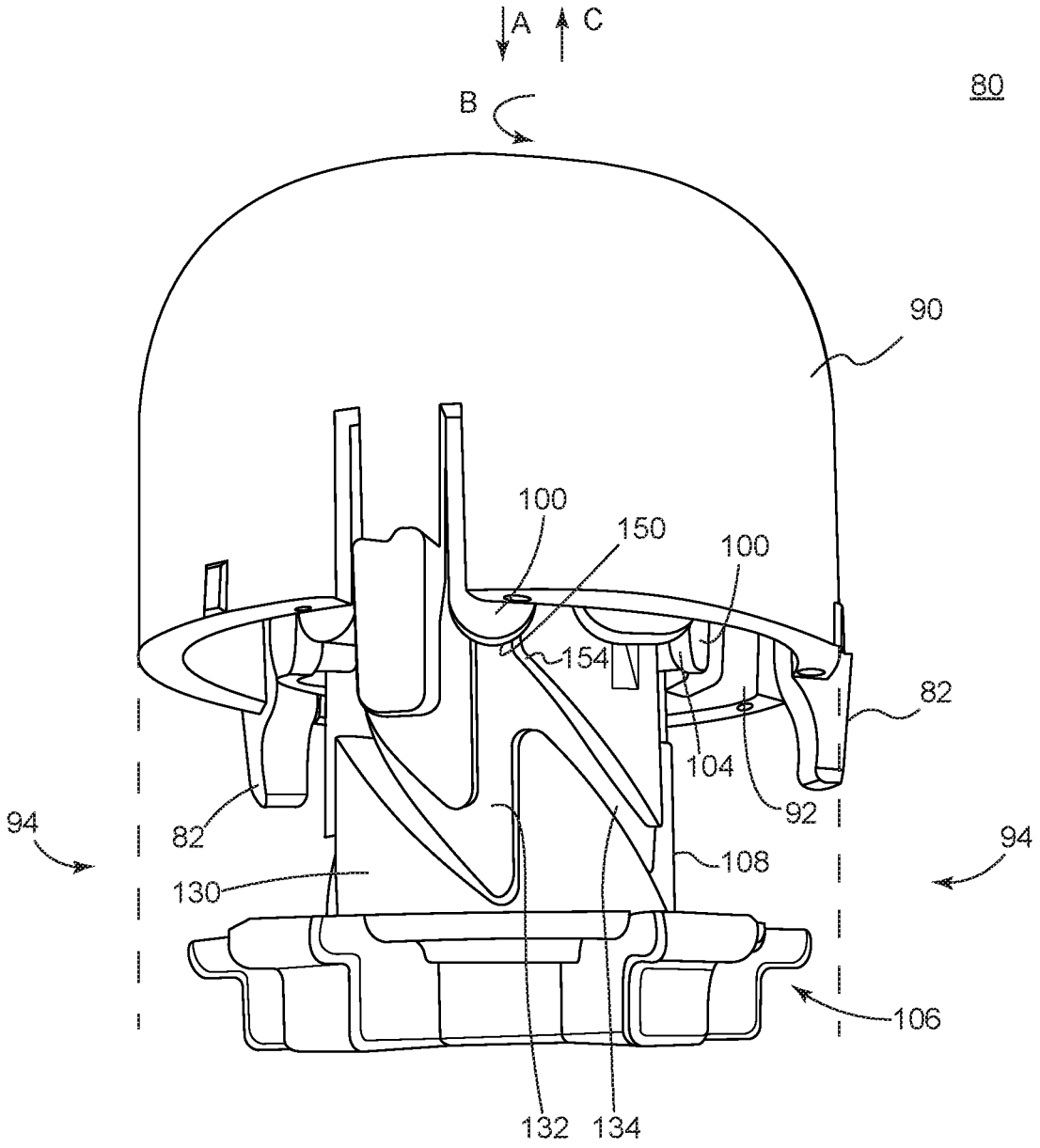
FIG. 7 is a perspective view of components of one embodiment of a snack containment and dispensing apparatus in accordance with the principles of the present disclosure.

In some embodiments, tray 14 is disposed with a bowl 24. Bowl includes an inner bottom surface that defines a protrusion, for example, a spindle 26, as shown in FIG. 4. Spindle 26 is configured for disposal with cavity 23 to facilitate rotation of tray 14 relative to bowl 24, as described herein.

Opening 22 defines a housing 30. Housing 30 includes a bottom surface 32 and a side wall 34. Housing 30 is configured for disposal of an actuator 80, as described herein. Housing 30 is substantially centrally located with tray 14 such that pockets 18 are disposed circumferentially about housing 30. Surface 32 includes an upwardly projecting spindle protrusion 36 and a plurality of drive knobs 38 substantially equidistantly located circumferentially about protrusion 36. Knobs 38 are separated by a gap 37. Knobs 38 each include a first ramp surface 40 and a second ramp surface 42. Surface 40 and surface 42 merge at an apex 44. In operation, a portion of actuator 80 is configured to translate along ramp surface 40, over apex 44 and along ramp surface 42 and into gap 37. When the portion of actuator 80 is disposed with gap 37, actuator is releasably fixed with tray 14 to resist and/or prevent rotation, as described herein. In some embodiments, knobs 38 are equally distributed. In some embodiments, the number of knobs 38 equals the number of pockets 18 to facilitate alignment of pockets 18 with opening 52, as described herein.

To keep snacks S from falling out of tray 14 during transport and/or maintain the freshness of snacks S, tray 14 includes a lid 50, as shown in FIGS. Lid 50 is substantially clear for viewing snacks S therethrough. Lid 50 includes a substantially round, circular shape configured to fit with tray 14.

Lid 50 includes an opening 52 is sized for alignment with one of pockets 18 to allow access to snacks S. Lid 50 includes a hinged flap 54 disposed with opening 52. Flap 54 is configured for disposal and alignment relative to a pocket 18 to allow access to snacks S. Flap 54 is configured for rotation about a hinge 56 for disposal between a closed orientation and an open orientation. Flap 54 includes a lock 58 that is configured to engage a surface of tray 14. In some embodiments, lock 58 is engaged with tray 14 via an integral connection, friction fit, pressure fit, interlocking engagement, mating engagement, dovetail connection, clips, barbs, tongue in groove, threaded, magnetic and/or key/keyslot.

Lid 50 includes a surface 60 that defines an opening 62. Opening 62 is aligned with housing 30 and configured for disposal of actuator 80, as described herein. Lid 50 is fixed with a portion of actuator 80 such that upon actuation of actuator 80 tray 14 is rotated relative to lid 50 to expose a single pocket 18. In some embodiments, actuator 80 includes spring tabs 82 configured to engage a portion of lid 50 to releasably fix actuator 80 with lid 50 to resist and/or prevent rotation of actuator 80 relative to lid. In some embodiments, lid 50 is connected with actuator 80 via an integral connection, friction fit, pressure fit, interlocking engagement, mating engagement, dovetail connection, clips, barbs, tongue in groove, threaded, magnetic and/or key/keyslot.

Actuator 80 includes a button 90, a collar 92, a rotation mechanism 94 and a housing 96. Button 90 includes a circular configuration and is configured to be pressed to actuate actuator 80, as described herein. In some embodiments, actuator 80 is configured as a plunger button.

Collar 92 is disposed with a cavity of button 90. Collar 92 includes a plurality of resiliently biased arms 100. One or more arms 100 includes a pin 104 protruding inwardly. Pins 104 are configured to engage a portion of rotation mechanism 94 to facilitate selective rotation, as described herein. Button 90 is moveable between a release orientation and locked orientation. In the release orientation, button 90 is biased upwards and can be pressed axially to actuate rotation of rotation mechanism 94. In the locked orientation, button 90 is fixed in a depressed orientation to resist and/or prevent rotation.

Figure 8:
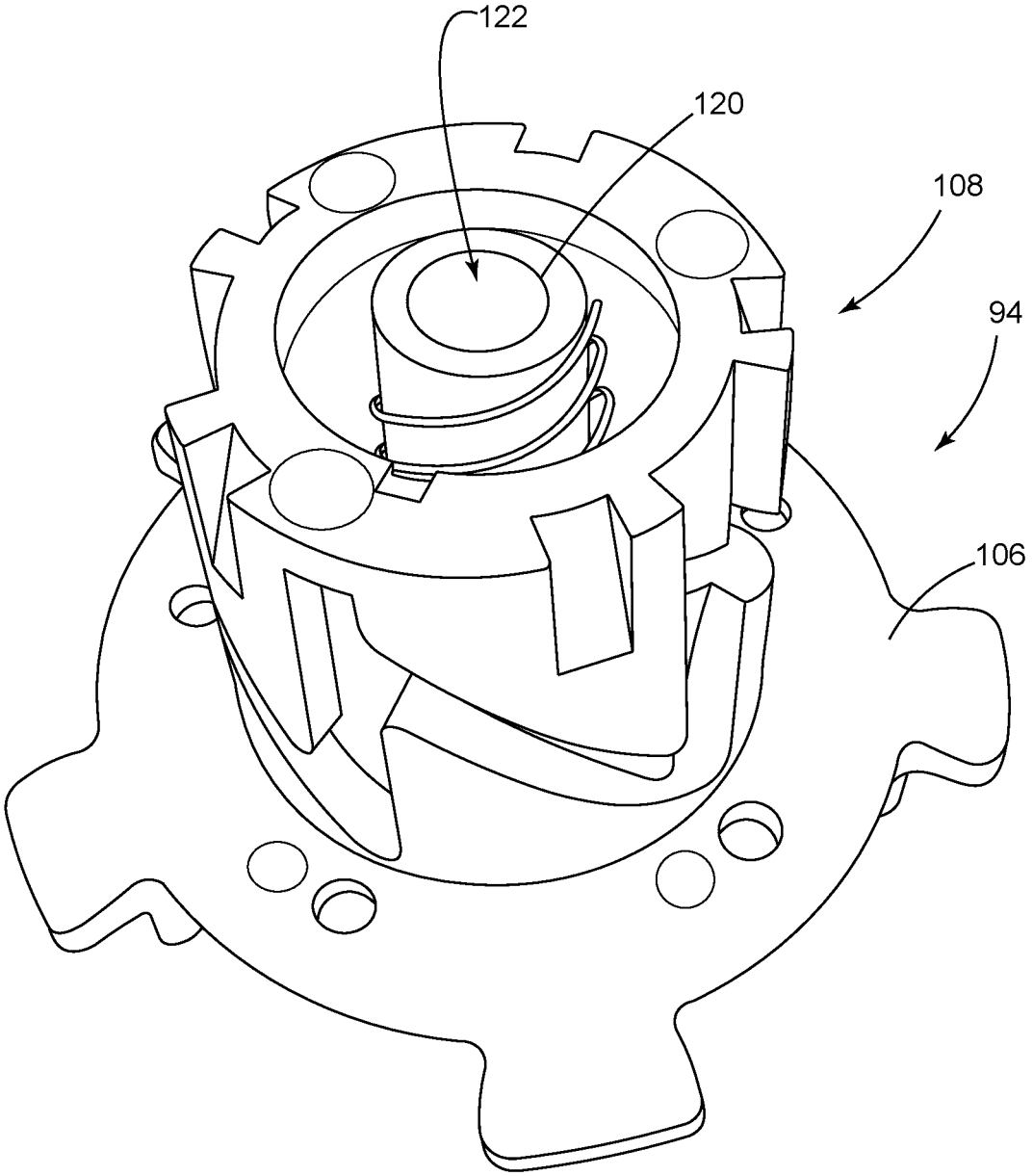
FIG. 8 is a perspective view of a component of one embodiment of a snack containment and dispensing apparatus in accordance with the principles of the present disclosure.
Figure 9:
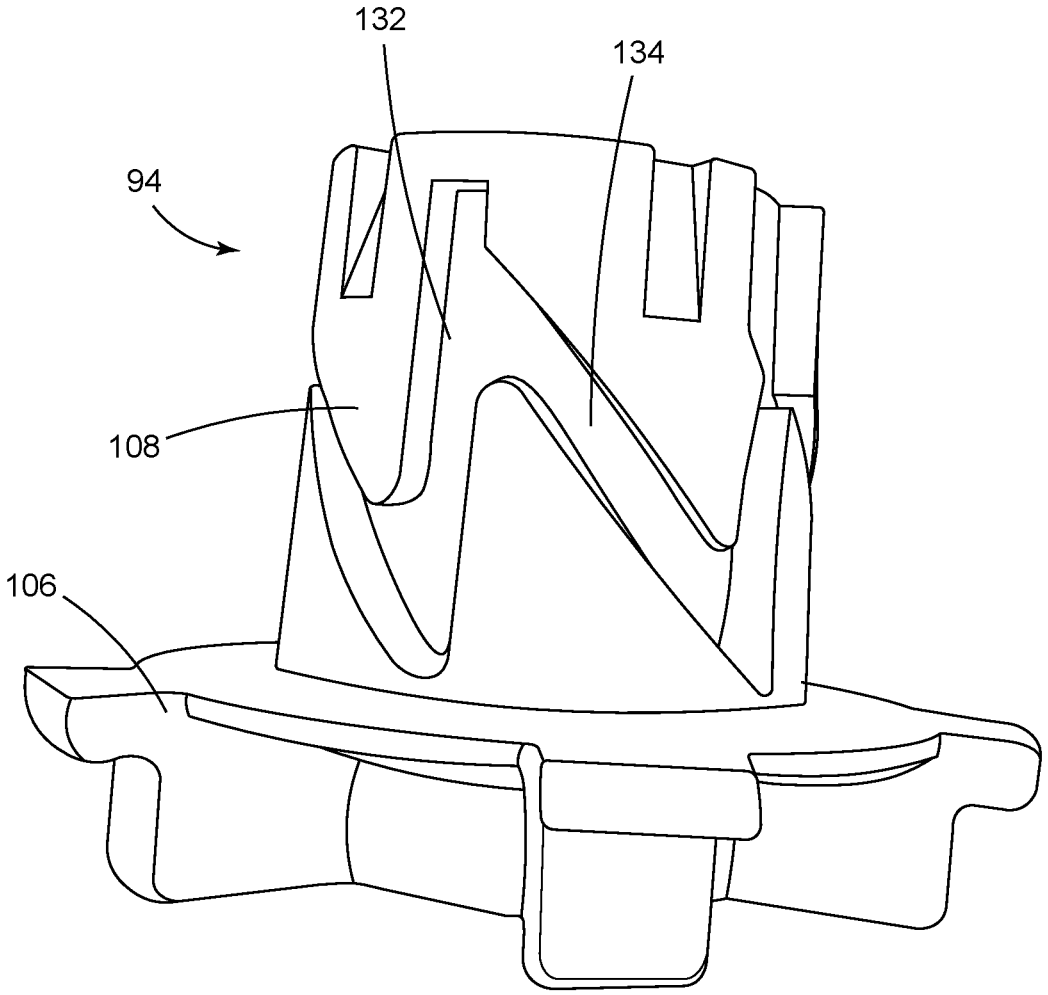
FIG. 9 is a side view of a component of one embodiment of a snack containment and dispensing apparatus in accordance with the principles of the present disclosure.
Figure 10:
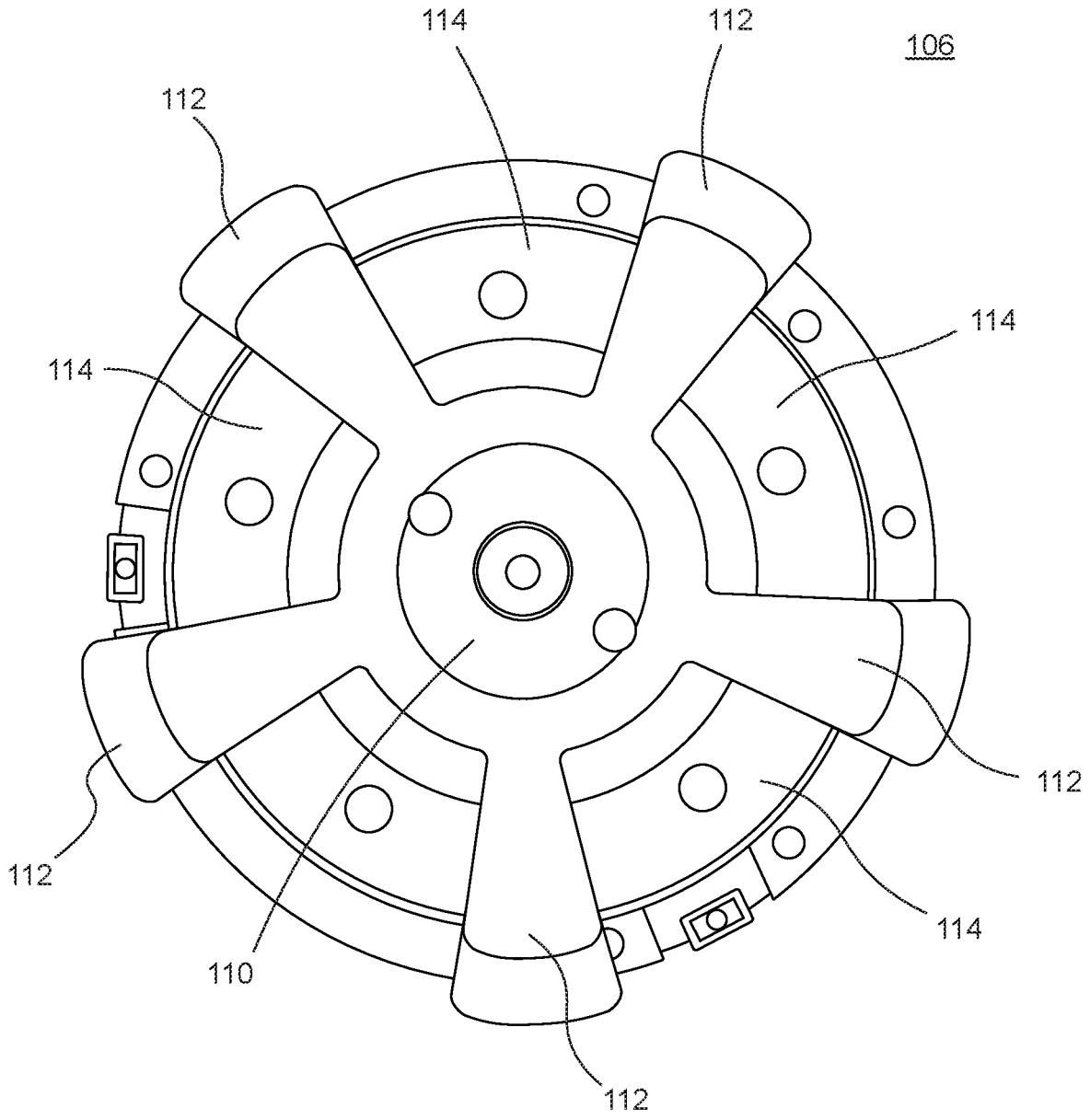
FIG. 10 is a bottom view of a component of one embodiment of a snack containment and dispensing apparatus in accordance with the principles of the present disclosure.
Figure 11:
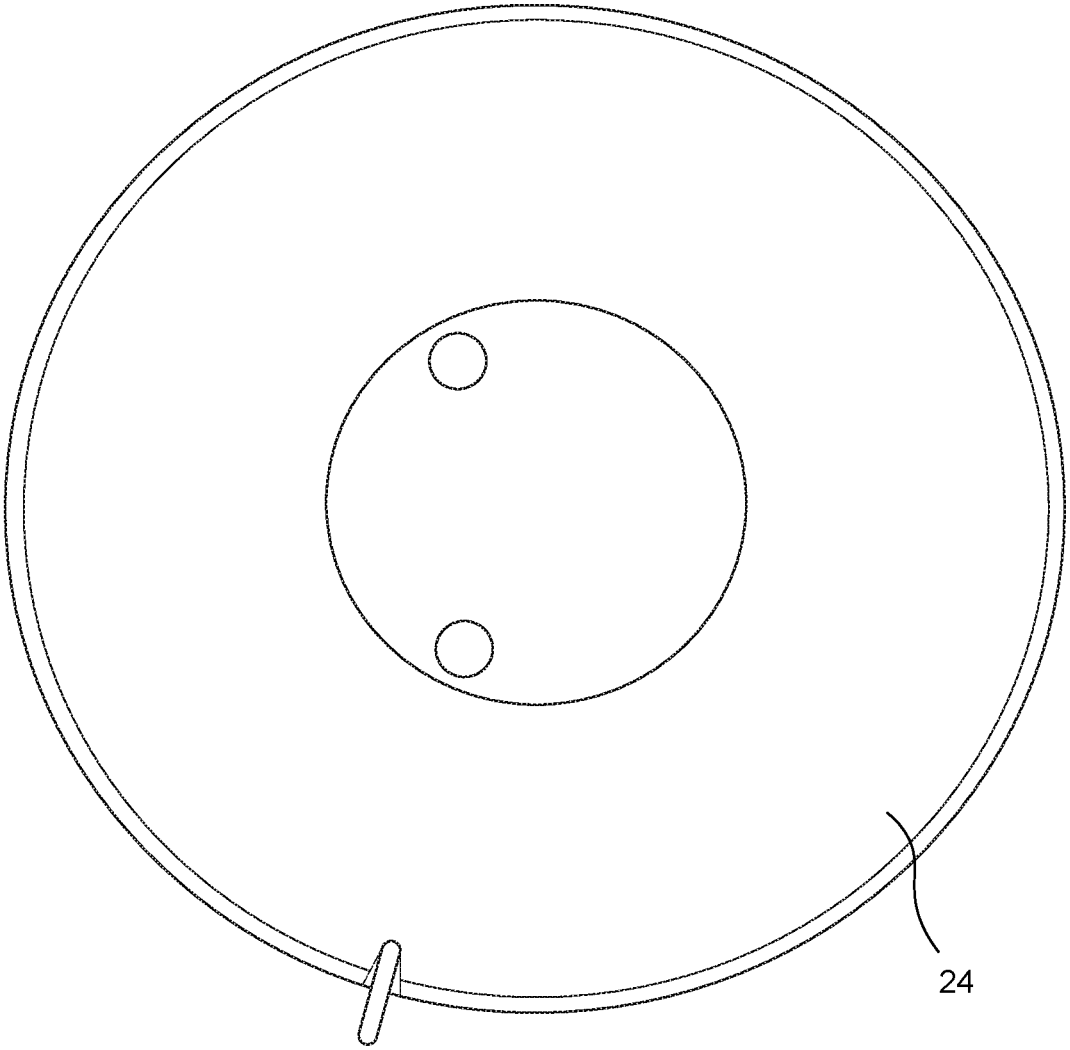
FIG. 11 is a bottom view of components of one embodiment of a snack containment and dispensing apparatus in accordance with the principles of the present disclosure.
Figure 12:
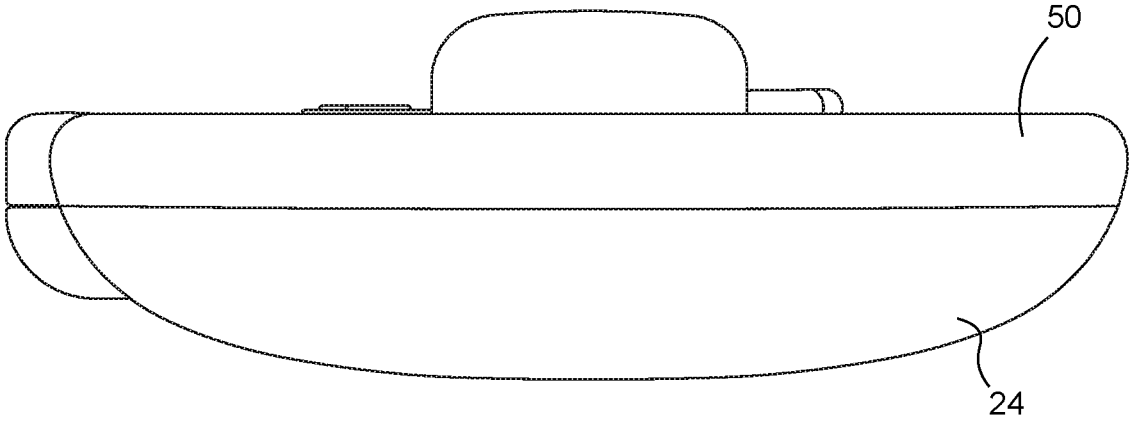
FIG. 12 is a side view of components of one embodiment of a snack containment and dispensing apparatus in accordance with the principles of the present disclosure.
Figure 13:
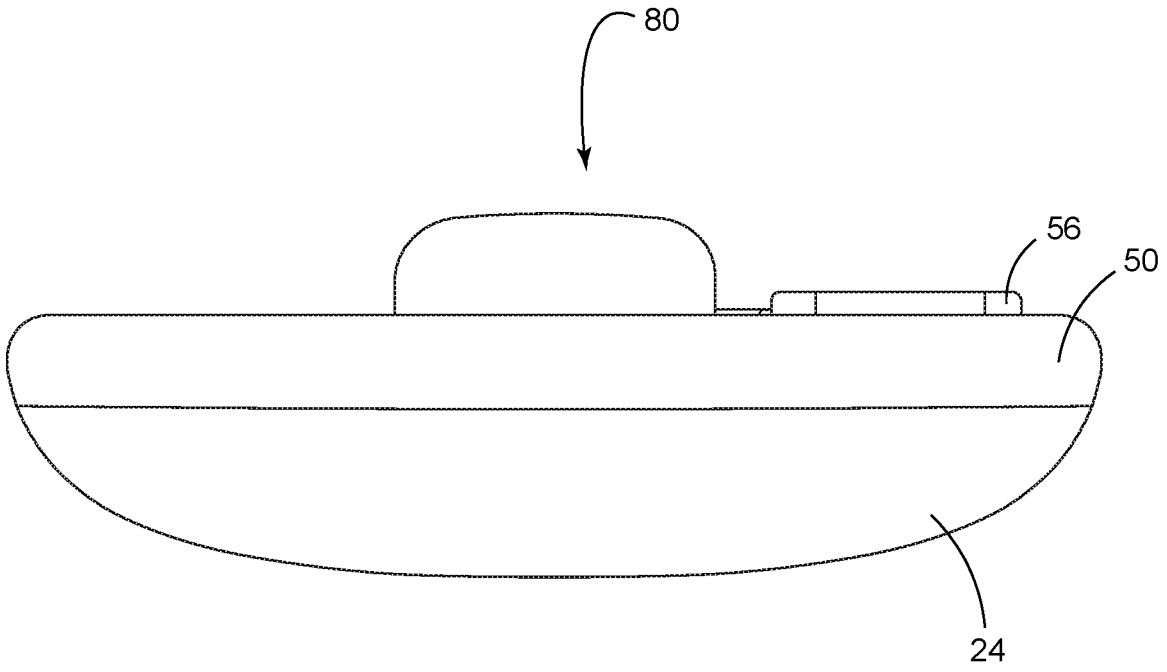
FIG. 13 is a side view of components of one embodiment of a snack containment and dispensing apparatus in accordance with the principles of the present disclosure.
Figure 14:
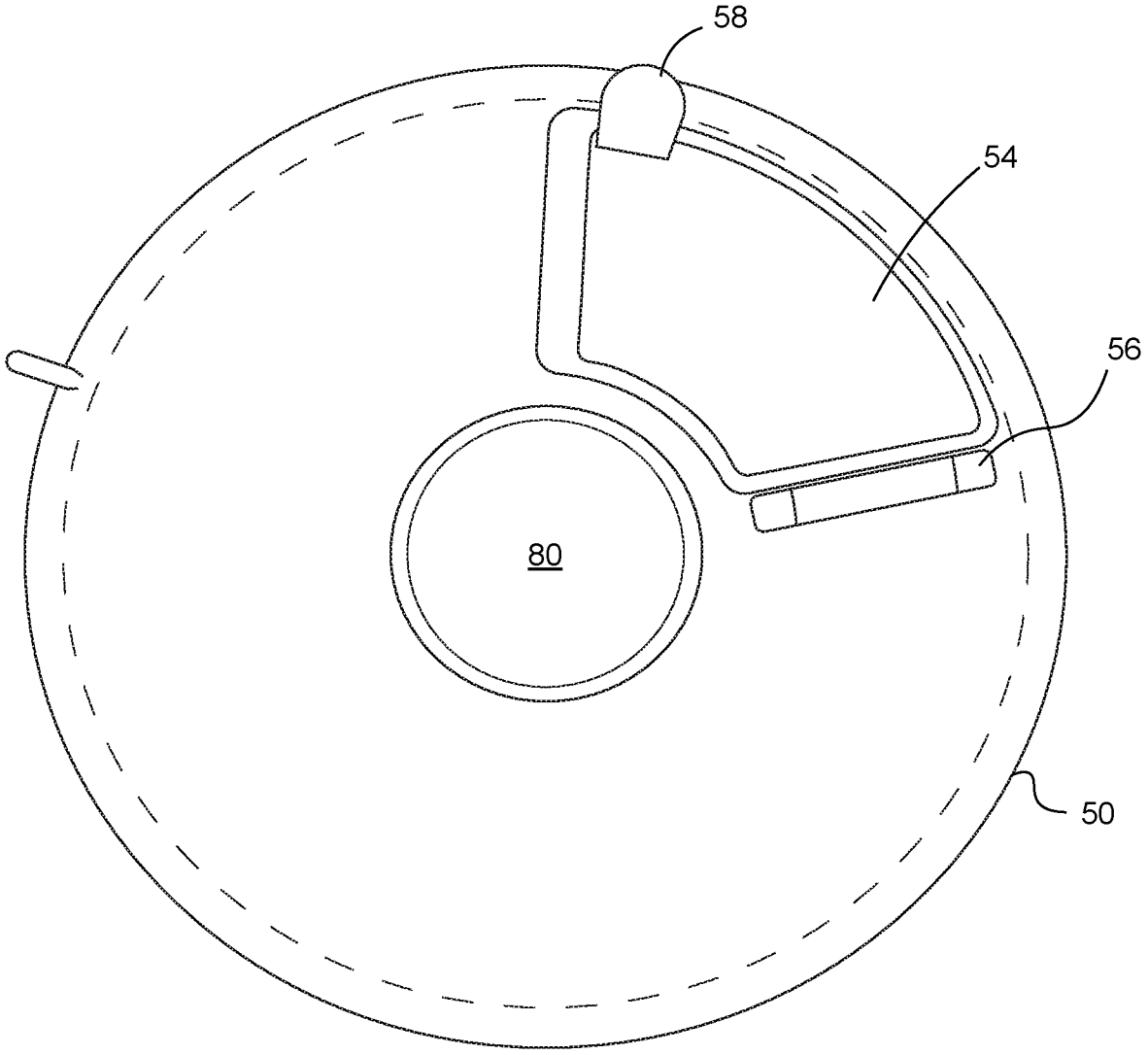
FIG. 14 is a top view of components of one embodiment of a snack containment and dispensing apparatus in accordance with the principles of the present disclosure.

Rotation mechanism 94 includes a base 106 and a tubular portion 108, as shown in FIGS. 8-10. Base 106 includes a cavity 110 configured for disposal of protrusion 36 to facilitate rotation of tray 14. Base 106 includes a plurality of extensions 112 circumferentially and equidistantly disposed about cavity 110. Extensions 112 protrude distally and are configured for disposal in gaps 37 of housing 30. Extensions 112 define drive pockets 114 therebetween. Drive pockets 114 are configured for disposal of knobs 37. During rotation, extensions 112 are configured to translate along ramp surface 40, over apex 44 and along ramp surface 42 such that knob 37 is disposed with an adjacent drive pocket 114 to facilitate selective rotation of tray 14.

Tubular portion 108 includes an in inner surface 120 that defines a cavity 122. Cavity 122 is configured for disposal of a biasing member, for example, a spring. The biasing member is configured to spring load button 90. The biasing member biases button into the release orientation between rotations of tray 14.

Tubular portion 108 includes an outer surface 130. Surface 130 includes a plurality of vertical channels 132 connected by transverse channels 134. At least one vertical channel 132 includes a ramped surface 136, inclining from a distal end to a proximal end. At least one transverse channel 134 includes a ramped surface 138, inclining from the proximal end towards the distal end. Channels 132 include a proximal portion 150 having a wall 154. Wall 154 is configured to resist and/or prevent unwanted rotation of actuator 80. Upon actuation, for example, pressing button 90 downward, as shown by arrow A in FIG. 7, pin 104 translates around wall 154 and distally along transverse channel 134. This causes rotation, in a direction shown by arrow B in FIG. 7, of rotation mechanism 94 and simultaneous rotation of tray 14. Releasing button 90, in a direction shown by arrow C in FIG. 7, causes pin 104 to translate proximally along channel 132 and into engagement with an adjacent proximal portion 150 and wall 154.

In some embodiments, tray 14 includes five pockets 18 and the selective rotation is one fifth of 360 degrees, for example, each rotation is 72 degrees. This selective rotation of 72 degrees is accomplished by collar 92 having five pins 104, rotation mechanism 94 having five vertical channels 132 and five transverse channels 134 equally disposed about rotation mechanism 94.

Container system 10 can be assembled and disassembled for cleaning and/or storage. For example, actuator 80 device is assembled such that the actuator 80 is rotatably positioned within lid 50 and housing 30 and actuator 80 is connected with lid 50 via spring tabs 82. Tray 14 is placed within bowl 24 such that tray 14 may substantially freely rotate. Base 106 is placed in housing 30 such that the drive pockets 114 are in drive contact with the knobs 38, and such that lid 50 comes into engagement contact with bowl 24.

With container system 10 assembled, actuator 80 is actuated, as described herein, which in turn causes tray 14 to index and/or rotate a predetermined and/or selected amount relative to bowl 24 such that an exposed pocket 18 is accessible and an unexposed containment compartment is closed. When the containment compartments contain a snack, a user, especially a child, experiences the entertainment and autonomy of choosing which snack to expose and subsequently retrieve and consume. It shall be noted that if all of the compartments contain a snack and the apparatus is overturned, only the snack in the open compartment is susceptible to spilling.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A snack containment and dispensing apparatus comprising:

a bowl;

a tray disposed within said bowl including one or more pockets;

a lid connectable with the tray and including a hinged opening formed in the top portion of said lid;

the tray configured for selective rotation relative to the bowl to align one of the one or more pockets with said hinged opening;

an actuator including one or more pins extending inwardly and including a rotation mechanism that includes a base and a tubular portion, the tubular portion including a plurality of vertical channels connected by a plurality of transverse channels where said plurality of vertical channels, said plurality of transverse channels, and said one or more pins are configured to actuate and facilitate selective rotation of the tray.

2. A snack containment and dispensing apparatus according to claim 1, wherein the lid includes a hinged flap disposed with the opening.

3. A snack containment and dispensing apparatus according to claim 1, wherein the base includes a plurality of extensions circumferentially and equidistantly disposed about the base.

4. A snack containment and dispensing apparatus according to claim 1, wherein the actuator includes a spring-loaded button.

5. A snack containment and dispensing apparatus according to claim 1, wherein the tray includes a housing configured for disposal of the actuator.

6. A snack containment and dispensing apparatus according to claim 1, wherein the housing is substantially centrally located with tray such that the pockets are disposed circumferentially about housing.

7. A snack containment and dispensing apparatus according to claim 1, wherein the housing includes an upwardly projecting spindle protrusion and a plurality of drive knobs substantially equidistantly located circumferentially about the protrusion.

8. A snack containment and dispensing apparatus according to claim 7, wherein the knobs are separated by a gap and a portion of the actuator is disposable with the gap to releasably fix the tray to resist and/or prevent rotation.

9. A snack containment and dispensing apparatus according to claim 8, wherein each of the knobs includes a first ramp surface and a second ramp surface that merge at an apex.

10. A snack containment and dispensing apparatus according to claim 8, wherein the actuator includes a plurality of extensions configured to translate along the ramp surfaces of the knob and into the gap during rotation of the tray.

11. A snack containment and dispensing apparatus comprising a bowl;

a tray disposed within said bowl having a plurality of containment compartments;

and a plunger device having a lid with at least one opening in the top portion thereof, said plunger device including one or more pins extending inwardly and including a rotation mechanism that includes a base and a tubular portion, the tubular portion including a plurality of vertical channels connected by a plurality of transverse channels where said plurality of vertical channels, said plurality of transverse channels, and said one or more pins facilitate selective rotation by said plunger device;

where said apparatus is adapted such that when said plunger is depressed, said tray indexes to move one of said plurality of containment compartments into vertical alignment with said at least one opening in said lid such that exposed access of a containment compartment is changed from a first containment compartment to a second containment compartment.

12. The snack containment and dispensing apparatus according to claim 11, wherein at least one of said containment compartments contains a snack therein.

13. The snack containment and dispensing apparatus according to claim 11, wherein said lid is substantially transparent.

14. The snack containment and dispensing apparatus according to claim 11, wherein when said containment compartments contain snacks and said apparatus is inverted, snacks contained in said containment compartments which do not have exposed access are prevented from spilling therefrom.

* * * * *